US009714790B2

(12) United States Patent
Bartosik et al.

(10) Patent No.: US 9,714,790 B2
(45) Date of Patent: Jul. 25, 2017

(54) PROCEDURE AND FACILITY FOR GRAIN MOISTURE CONTROL

(71) Applicant: INSTITUTO NACIONAL DE TECNOLOGIA AGROPECUARIA, Ciudad Autonoma de Buenos Aires (AR)

(72) Inventors: Ricardo Bartosik, Balcarce (AR); Diego De La Torre, Balcarce (AR)

(73) Assignee: Instituto Nacional De Techologia Argopecuaria, Ciudad Autonoma de Beunos Aires (AR)

( * ) Notice: Subject to any disclaimer, the term of this patent is extended or adjusted under 35 U.S.C. 154(b) by 462 days.

(21) Appl. No.: 13/911,978

(22) Filed: Jun. 6, 2013

(65) Prior Publication Data

US 2014/0360045 A1 Dec. 11, 2014

(51) Int. Cl.

| | |
|---|---|
| ***F26B 23/02*** | (2006.01) |
| ***F26B 25/10*** | (2006.01) |
| ***F26B 21/08*** | (2006.01) |
| ***F26B 9/06*** | (2006.01) |
| ***F26B 25/22*** | (2006.01) |

(52) U.S. Cl.

CPC ..... *F26B 25/10* (2013.01); *F26B 9/063* (2013.01); *F26B 21/08* (2013.01); *F26B 23/02* (2013.01); *F26B 25/22* (2013.01); *F26B 2200/06* (2013.01)

(58) Field of Classification Search

CPC ..... F26B 9/063; F26B 17/12; F26B 17/14; F26B 23/02; F26B 25/10; F26B 25/22; F26B 2200/06; F26B 21/08; F26B 21/10

See application file for complete search history.

(56) References Cited

U.S. PATENT DOCUMENTS

| | | | | |
|---|---|---|---|---|
| 4,253,244 A * | 3/1981 | Kranzler | ..... | F26B 25/22 34/233 |
| 4,688,332 A * | 8/1987 | Kallestad | ..... | F26B 3/06 34/491 |
| 4,750,273 A * | 6/1988 | Parkes | ..... | F26B 25/22 34/484 |

* cited by examiner

*Primary Examiner* — Jiping Lu

(74) *Attorney, Agent, or Firm* — Muncy, Geissler, Olds & Lowe, P.C.

(57) ABSTRACT

A facility for controlling moisture in grains provided with a grain storage silo conveniently installed on a hard flat floor and inside of which a raised floor drilled with air passageways is provided, determining an air chamber inside the silo and below the perforated floor, into which previously conditioned air is blown by an air heater, wherein the control of hot air blowing times is determined based on modeling and calculating carried out by a programmable controller operatively connected to an ambient air temperature sensor located outside the silo, an ambient relative humidity sensor located outside the silo and a temperature air sensor located into the air chamber inside the silo, thereby causing the application of different stages of drying, rewetting and maintenance of the first bottom layer of grain, ranging between an upper and lower moisture limits narrowing around the desired moisture while the drying progress, leading to an homogeneous final moisture content of all the grain bulk.

8 Claims, 7 Drawing Sheets

PROCEDURE AND FACILITY FOR GRAIN MOISTURE CONTROL

FIELD OF THE INVENTION

The present invention relates to the field of devices, machines or apparatus for conditioning and moisture control of bulk materials, such as grains or seeds stored in silos; more specifically the present invention relates to a novel system for grain moisture control, capable of performing a novel predictive method for grain moisture control by means of an open loop control.

BACKGROUND OF THE INVENTION

In order to better understand the object and scope of the present invention, it is convenient to describe the closest known prior art regarding the use of facilities or silos for grain storing and drying, as well as the commonly used moisture control and temporary storage procedures of the harvested grain.

In the present specification the terms "moisture" or "humidity" may be used interchangeably, but preferably the former is applied to solid products and the latter to gases, particularly air.

In principle, the inventors of the present invention have observed a noticeable lack of offer in the market concerning facilities for grain moisture conditioning with natural air and/or low temperature. In general, they have observed that the facilities currently available in the market are not especially suited for different climatic zones, they are not especially designed for easy cleaning and access by operators and do not provide duty cycles prioritizing a gentler grain treatment in order to better preserve its qualities, especially when it comes to conditioning high value grains, at the expense of a slower drying speed. They have also observed that there is still a need of process optimization, in order to obtain a more economically profitable process with lower operating temperatures (prioritizing grain quality) compared to grain dryers currently available in the market.

The purpose of grain moisture conditioning or control facilities is to bring and maintain the grain moisture content within a commercially and technically acceptable range. In this regard, it may be possible both to provide as well as to remove moisture therefrom in order to reach the optimal moisture percentage, however, typically the most common task is to reduce the moisture content in the grain, which usually comes from harvest with an excess moisture regarding commercial and conservational standards. As mentioned above, this type of facility is known to those skilled in the art simply as "grain dryers" including facilities that only allow reduction of grain moisture. Moreover, those that can also increase and/or homogenize the moisture content in the grain mass are known as conditioning systems. Therefore, for all practical purposes the term "grain dryer" can be understood as also referring to a grain moisture conditioner or regulator, as is apparent to a person skilled in the art.

Grain dryers can be classified as high temperature, intermediate temperature and low temperature dryers. High temperature dryers are the most widespread in the market, and consist of drying columns or chambers, vertically arranged (towers) in which the moist grain enters through the top and the dry grain exits through the bottom. Typically these are high drying capacity dryers, but do not prioritize grain quality. Low temperature dryers generally consist of a silo with special characteristics, where the drying/conditioning takes place slowly and uniformly with air at room temperature or heated slightly above room temperature. These dryers/conditioners are known for their excellent drying quality.

Constructively, grain dryers and grain drying facilities using metal silos are usually of the raised-on-columns type, these being the smallest in size, processing and storage capacity; or of the type using larger metal silos, which are usually supported on the ground, after a civil engineering work that serves as a support and floor for the silo bottom structure, included in said civil engineering work the creation of a double-decker floor and a possible inlaid pipe design and conduits needed for its operation.

Broadly speaking, a typical grain drying process starts with loading the grain into the silo. Said grain loading is obtained by lifting and dumping the grain by using, an auger, bucket elevator, wheel, conveyor belt or the like as a means of grain elevation, so as to introduce the grain usually through the center of the silo roof. After placing the bulk material inside the silo, whether said silo is full or not, a variety of fans, exhaust fans, temperature and moisture sensors, heaters and channel opening and closing shutters and other devices are generally connected to the silo in order to circulate an air flow through the grain mass in a more or less continuous way, wherein said air flow draws moisture from the evaporation of water contained in the stored grains. Generally, the construction involves incorporating a double-decker floor into the civil engineering work, or a series of grids, and air blow pipes among other options in order to force a generally upwards air circulation through the stored grains, in order to achieve a moisture removal effect.

However, the control exerted over this air flow process, is as simple as manually turning on and off a fan and manually measuring grain moisture by the staff handling the facility, and as complex as incorporating computers and multiple closed-loop continuous feedback control sensors. Examples of known methods and devices can be found in U.S. Pat. Nos. 4,583,300, 4,750,273, 4,916,830, 5,167,081 and 5,551,168.

It is also known that the air entering the silo is taken from the atmosphere, therefore the temperature and moisture conditions of said inlet air are those of the reigning climate. This implies that the atmospheric air can be as moist as or even moister than the grain mass. In this sense, the options for conditioning said inlet air are to modify its temperature and/or moisture, in order to obtain the moisture absorption effect from the grain mass throughout which said air circulates and produce the drying effect on the grains. It should be noted that increasing the air temperature is a practice that causes the lowering of the air relative humidity and thus increases its moisture from the grain mass absorption power.

In general, the average humidity or moisture of the grain mass required for a certain grain type and a particular intended use is well known to a person skilled in the art. For this reason, the grain drying process seeks to obtain an optimal grain mass average humidity reading, for both conservation and commercialization or industrialization. As an example, popcorn must have an average grain mass moisture content in the order of 14.5% in order to be considered ready for commercialization, and it is therefore understood that higher humidity values such as 18% would not achieve the required quality for its commercialization, thus having to submit the overly moist grains to a drying process in a facility meant for such purpose. In general, in order to obtain the desired moisture content, i.e. the optimum value for conservation and subsequent commercialization, it is necessary to remove moisture from the grain, this being the most common procedure. However, in general, conditioning the grain involves keeping the grain mass within an average moisture range, which may also involve the addition of moisture if said grain mass is too dry. The latter is hardly representative of the grain conditioning processes and can occur in special situations such as in very dry climates or regions and/or a prolonged sun and dry wind exposure of the crop prior to its harvest.

It is for the above mentioned reasons that the inventors of the present invention detected a need for a new type of grain drying facility and an operation procedure allowing the drying of grains with the lowest possible air temperature compared to those currently used in the market, providing a relatively slow drying in order to enhance uniformity in grain drying, maintaining its viability as a seed and decreasing the amount of cracked grains, all this carried out by a novel open-loop predictive control of proven efficiency.

BRIEF DESCRIPTION OF THE INVENTION

It is therefore an object of the present invention to provide a facility to control the moisture of a bulk material stored in a container silo, providing a simple and effective way of setting up said facility without the need of complex civil engineering works, easing its assembly by means of adopting a generally flat base floor of a rigid material on which the perimeter wall of the container silo is positioned and held; as well as providing an easy and effective way of holding said bulk material while blowing the air through the air blowing means, such as by adopting an elevated floor with respect to said floor base, contained within the perimeter wall of said silo, wherein said elevated floor comprises a plurality of holes which define air passages with a relative area of about 15% to about 30% of the total area of said elevated floor, defining an air chamber between said base floor and said elevated floor and an air heating means connected prior to the air flow into said air chamber.

It is also an object of the present invention to avoid direct and continuous moisture measurement of the grain mass, to which end, at least one air temperature sensor means in at least one temperature reading point located inside the air chamber, at least one temperature sensor means and at least one ambient air relative humidity sensor means located externally of said silo are incorporated, so as to measure the grain moisture content by layers only in the beginning of the process and before starting the moisture control, thus proceeding in a predictive manner and not by direct feedback of the moisture measurement of the same bulk material to which the method of moisture control is applied.

To this end, an electronic control means is operatively connected to said air blowing means, to said air heating means and to said sensor means, wherein said electronic control means includes an initial data recording means from such sensor means, a desired bulk material moisture value input means, and a means of modeling and calculating on and off times as well as an operating power control of at least said air heating means.

It is also an object of the present invention to provide a facility for grain moisture control in which said air blowing means may be implemented in a convenient manner by adopting a centrifugal fan with an air circulation rate based on the weight of the bulk material in the range of about 1 to 2 $m^3/(min \cdot t)$ and adopting a gas burner as said air heating means.

It is also an object of the present invention to provide a procedure for grain moisture control to be applied with the humidity control facility, adopting a layered division of the bulk material contained in said silo, as a way of discretizing the model and the calculations, thereby determining a plurality of layers of bulk material and thus being able to record the initial moisture and temperature values of at least the bottom layer of said plurality of layers, a measurement which is convenient and easy to obtain; then calculate from these values the changes in temperature and humidity caused by moisture reduction power and circulating air flow temperature;

Additionally, in order to model and calculate the progress of the working stages without resorting to direct feedback processes of moisture measurement in the bulk material, the initial moisture value of at least said lower layer is recorded, and the circulating flow rate is recorded in said initial data recording means of said sensor means of said electronic control means; also in order to perform said modeling and calculation the desired bulk material moisture value is recorded in said desired value recording means of said electronic control means.

Additionally, in order to model and calculate the progress of the working stages without resorting to direct feedback processes of moisture measurement in the bulk material, a humidity range has been established, which comprises a lower desired moisture limit and a upper desired moisture limit obtained from tolerance values preset to be greater and smaller than said recorded desired moisture value of the bulk material, and the activation of a process stage is determined by means of said modeling means and on-and-off time calculation as well as the operating power control of at least said heating means, being the possible process stages as follows:

- a drying stage comprising the activation of the air blowing means and if the ambient air humidity is greater than the calculated humidity required to lower the moisture of the bulk material, the activation of the heating means, and where this drying stage is activated if the moisture value of said first lower layer of bulk material is greater than said moisture upper limit;
- a maintenance stage comprising the activation of the air blowing means and where this maintenance stage is activated when the moisture value of said first lower layer of bulk material is comprised within the range determined by said upper and lower moisture limits; or
- a re-humidification stage comprising shutting down said air blowing means if the relative humidity of the ambient air is less than the one indicated for re-humidification of the bulk material, or activating said air blowing means if the relative humidity of the ambient air is suited for re-humidification of said bulk material and where this re-humidification stage is activated if said moisture value of said first bottom layer of the bulk material is below said lower moisture limit.

It is also an object of the present invention to provide a drying stage and a re-humidification stage in such a way that they are predictively driven, adopting to this end the periodic calculation of the temperature variation of each of said at least one layer, and the reading of the temperature value of said temperature sensor in said air chamber, without the need for new moisture measurements in said first layer of the bulk material, determining by the use of said modeling and calculation means the degree of progress of the active stage, until said stage reaches one hundred percent progress, additionally making use of equilibrium equations comprising, at least one heat balance equation between the air and the bulk material, at least one mass balance equation between the air and the bulk material, and at least one balance equation between the equilibrium moisture content (EMC) of the bulk material and the equilibrium air relative humidity (ERH) and as described in detail below.

BRIEF DESCRIPTION OF THE DRAWINGS

For clarity purposes and to provide support to the present description and to provide an example of a preferred embodiment of the invention, accompanying drawings are provided and described in detail below.

DETAILED DESCRIPTION OF THE INVENTION

In order to explain in a clearly manner one of the ways of carrying out the present invention, an embodiment of the present invention as a preferred example will be described in detail below.

It should be noted that the information disclosed herein enables a person skilled in the art to implement the present invention, and further implement other equivalent embodiments with the aid of what is herein written and illustrated.

General Components of the Facility

Figure 1:
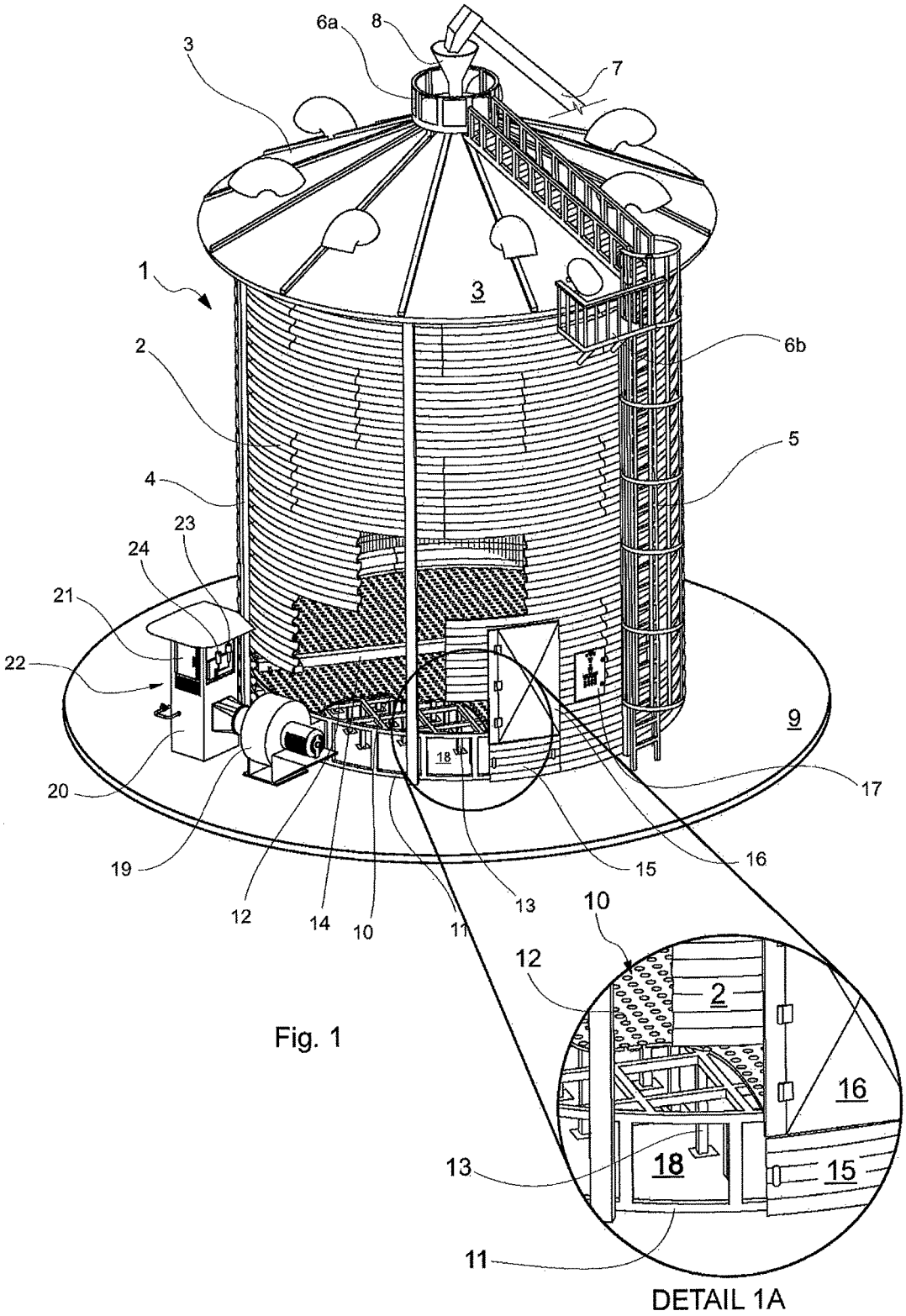
FIG. 1 is a perspective view and a partial section of the moisture control facility of the present invention according to a preferred embodiment, further illustrating an enlarged detail referred to as Detail-1A, in order to better appreciate the inside of the silo.

The grain humidity control facility according to a preferred example of an embodiment of the present invention has a general appearance as illustrated in FIG. 1, which distinguishes a silo (1) with a generally cylindrical shape preferably made of galvanized steel sheets (also known as zinc plates) shaped and bolted together so as to obtain the curved wall (2) laterally defining the grain storage enclosure; all of this being crowned at the top with a conical roof (3) also with zinc steel sheets. A plurality of reinforcement uprights or columns (4), are arranged outside on the contour of the perimeter wall (2) adding structural strength to silo. An external staircase (5) can also be observed, which rises above the roof of the silo, wherein a variety of inspection platforms (6*a*), (6*b*) with guardrail are arranged. The latter surrounds a funnel or load hopper (8) in which in a preferred embodiment the dispensing outlet of a grain elevator (7) propelled into the silo (1) discharges its contents.

Particularly, the perimeter wall (2) of the silo (1) of the present invention is supported on a flat base (9), usually flat and rigid. The term "rigid" is intended to mean having sufficient structural stiffness, such as in the case of reinforced concrete, in order to form a slab which allows firmly supporting the entire silo structure and its weight. The perimeter wall (2) is secured to the slab (9) by expansion bolts and the connection between both is sealed either with the use of silicone sealants, rubber strips and/or also by a rubber ring, among other options.

In FIG. 1, and for illustrative purposes, some of the zinc sheets have been removed in order to allow viewing the inside of the silo, also accompanied by an enlarged detail referred to as Detail 1A. Inside the silo (1), it is then possible to observe the existence of an elevated floor (10) preferably suspended at a height of approximately 0.57 meters above the reinforced concrete slab (9); this can be obtained in a convenient way by incorporating a support frame (11) intermediately between the concrete floor (9) and said elevated floor (10).

The elevated floor (10) is advantageously positioned at a predefined distance relative to the slab (9), avoiding previous civil engineering constructions frequent in traditional drying silos. It is simply enough to provide a smooth surface (9) as the one described for carrying out the conformation of this elevated floor (10) by placing said support frame (11).

In particular, said elevated floor can be made with a steel plate thick enough to support the weight of the grain to be dried, and it incorporates a plurality of holes (12) that will serve as an air passage for the purposes of the present invention, but that will not allow the grains to fall through them. To this end, when drilling the holes, a preferred diameter for circular holes is approximately 4 mm; additionally, the total perforated surface allowing the passage of air is preferably in the range of 15% to 30% of the total area of the elevated floor (10), and even more preferably is at least 20% of the total area of the elevated floor (10).

Furthermore, said support frame (11) is preferably constructed as a grid and/or truss of welded tubes, which copies the generally circular shape of the elevated floor (10) and supports said floor, being the frame (11) supported by sticks or studs (13) contained within the silo and welded to the grid intersections, the bases of which rest on the slab (9). Generally, then, the support frame (11) has an upper grid assembled from welded metal tubes and supported by a plurality of sticks or studs (13) acting as short columns of welded metal tubing. This arrangement is particularly advantageous for a rapid assembly and even for adapting pre-existing silos, transforming them into grain moisture control facilities according to the present invention.

The adoption of an elevated floor (10) with holes (12) spaced a certain distance from the slab (9), allows obtaining an air chamber (18) laterally confined by the wall (2) of the silo (1). Said chamber or confined space for the purposes of the present invention will be referred simply as a plenum during the description; a term which is widespread and known to those skilled in the art.

In this way, said plenum provides an enclosed space where the air is evenly distributed and its pressure is slightly raised in order to force its way up through said elevated floor (10) which includes holes. This air chamber (18) will also be used, as described below, to provide enough space for the extraction of the grain dispensed from a central discharge port and another lateral discharge port of the elevated floor (10).

Figure 4:
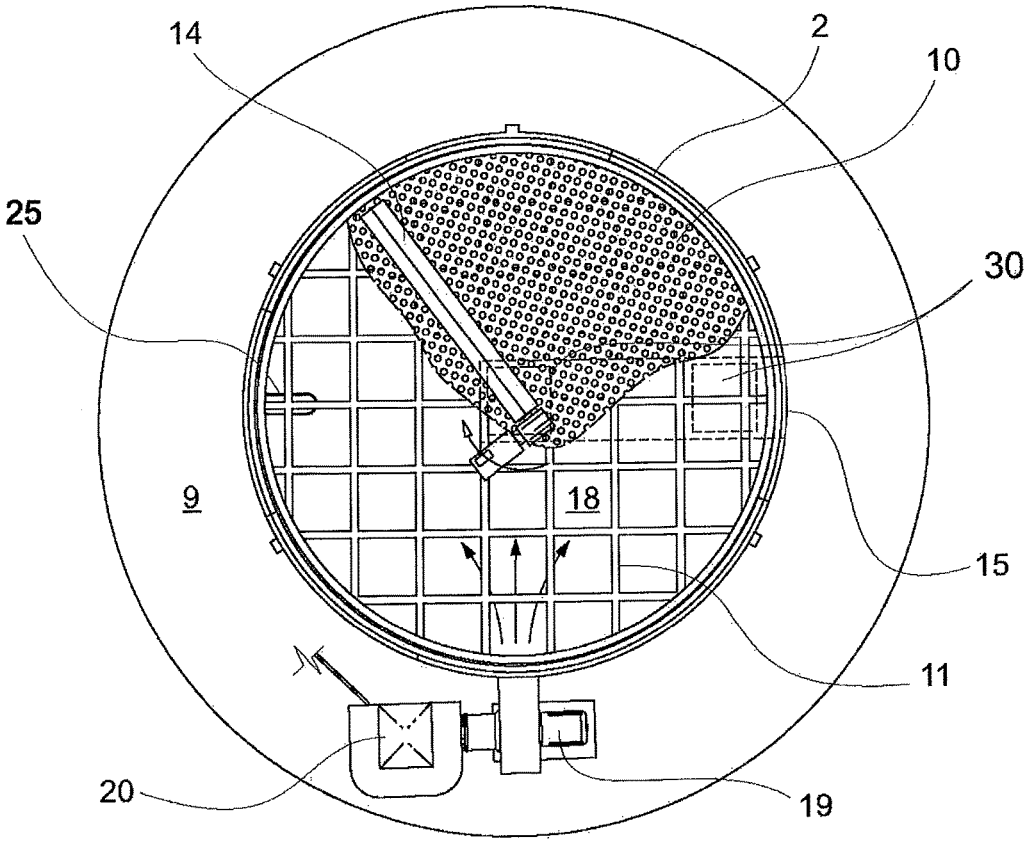
FIG. 4 is a top view and a partial section, partially illustrating the supporting floor of the bulk material, the air flow into the air chamber under the floor and one of the preferred positions for the temperature sensor, among other details.

Generally, the extraction of grain is obtained with the aid of a sweep auger (14) located inside the silo (1) and above the elevated floor (10), its use and operation is known to those skilled in the art, and it is based on the rotation of the screw around the central axis of the silo (1), generating a flushing effect as the screw rotates to push the grain towards the center of the elevated floor (10). Said elevated floor (10) includes a central discharge outlet through which the grain is dispensed downwardly from said elevated floor (10). Said outlet is not always open, and for this purpose has a sliding gate of the guillotine type (not shown) that allows the opening of said outlet at the time when grain extraction is needed. In particular, for the purposes of the present invention, the discharge is done by inserting a conveyor belt through the access door (15) to the plenum, and opening the guillotine type gates arranged for the central and side discharge outlets (30) (see location thereof in FIG. 4).

Being one of the objects of the present invention to allow for better access and cleaning inside the silo (1), an access door (16) is provided with a preferred size of 1.8 meters high and 0.5 meters wide, allowing entry of a person and cleaning elements in a comfortable manner. Since said access door (16) is elevated, suitable fixed, removable and/or retractable ladder, rung and/or steps (not shown) are provided in order to conveniently access said door.

The detailed description of the silo of the present invention will be completed below by describing the procedure to be used in the facility of the present invention, in order to help understand and describe the remaining components of the novel facility and how said components relate to each other.

Grain Drying Procedure

It is evident that, being the drying of the grains a primary object of the present invention, the first consideration is in reference to that the silo (1) must contain at least an initial grain load, or that at least one silo (1) loading or filling stage with the bulk material must be performed, particularly in this case, from grain farming (crop).

Figure 2:
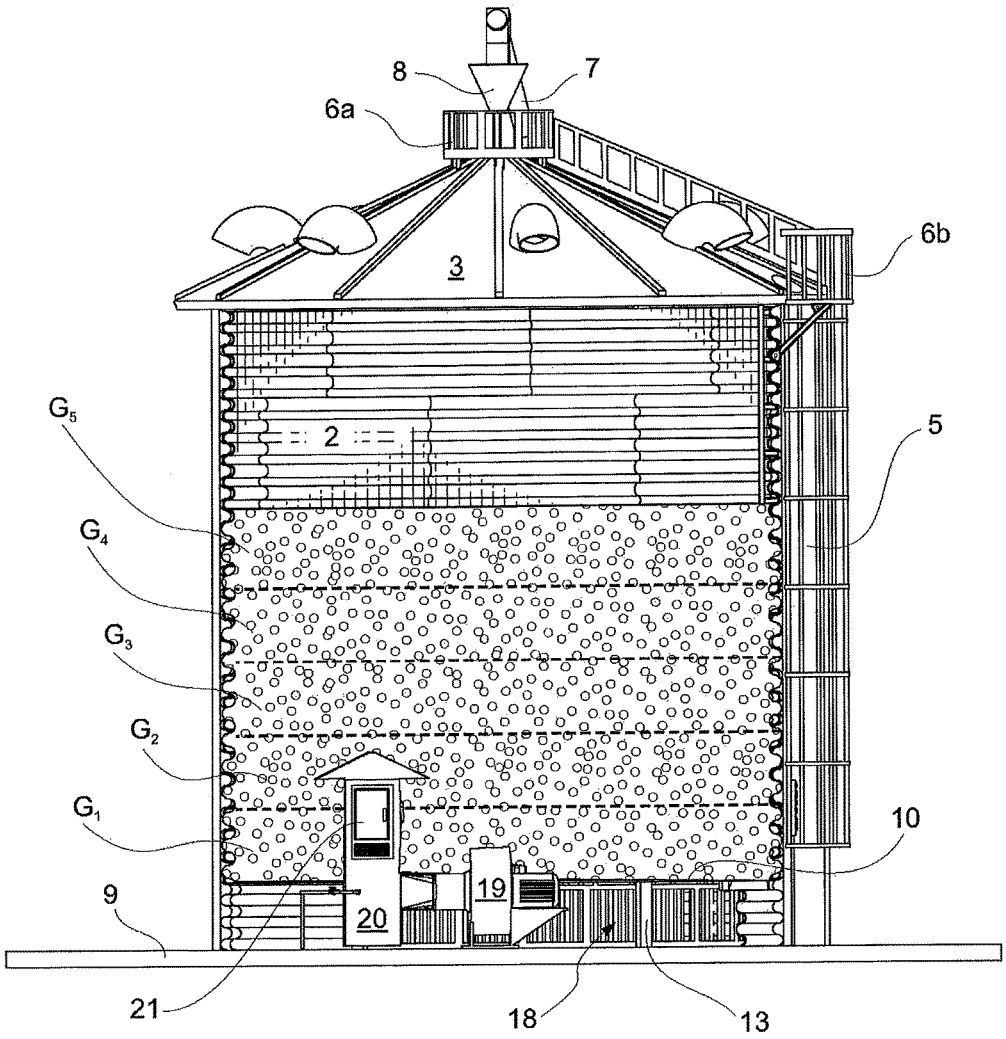
FIG. 2 is a side view and a partial section of the facility as an example of the embodiment in FIG. 1, taken from a leftmost position to said FIG. 1, in order to better illustrate the heating and air blowing facilities.
Figure 3:
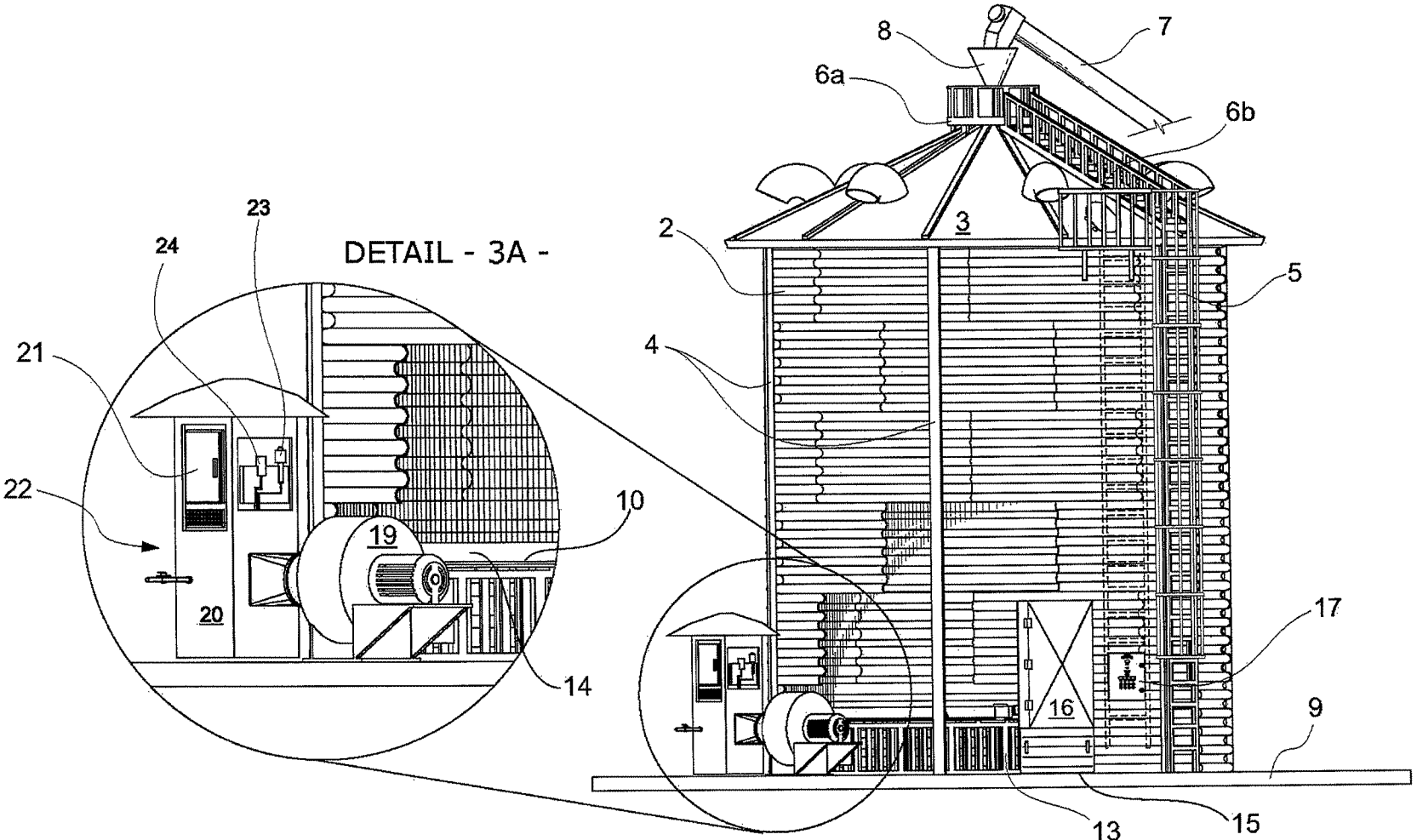
FIG. 3 is a side view and a partial section of the humidity control facility according to the preferred embodiment of the present invention, further illustrating an amplified detail—3A—of such heating and air blowing facilities and the external sensors.

In a preferred manner illustrated in FIG. 2, a silo (1) with grain inside can be observed, in particular and for purposes of the present invention, the total content of grain within the silo will be considered as deposited in layers ($G_1$, $G_2$, $G_3$, etc.), namely, the first grain layer ($G_1$) or lower layer is in contact with the elevated floor (10); the second grain layer ($G_2$) is the layer immediately above the layer ($G_1$); the third grain layer ($G_3$) is the layer directly above the layer ($G_2$), and so on. The number of layers can vary depending on the size of the silo (1) and the amount of grains inside, however in a preferred embodiment, the thickness of each layer is set to about 1 meter. As an example, in FIG. 2 of the present invention, five layers of 1 m each ($G_1$, $G_2$, $G_3$, $G_4$ and $G_5$) are arranged.

The division into layers is important for the purposes of the present invention because, in principle, it is necessary to establish the average temperature and humidity of the grains contained in at least the first layer, in order to apply the predictive model to the facility of the present invention. Even more preferably in each layer contained in the silo.

For the grain layer ($G_1$), the average temperature ($T_1$) and grain moisture ($H_1$) are obtained by a moisture measuring device (moisture meter) or the like, before or after loading into the silo, subsequently proceeding in the same way with each layer. Experiments have shown that the temperature values (° C.) $T_1$, $T_2$, $T_3$, etc., and (%) $H_1$, $H_2$, $H_3$, etc. are generally uniform enough to assume that the entire layer has the same temperature and humidity.

Since the facility is built up so as to allow air entry into the plenum (18), the introduced air stream is provided by at least one fan (19) acting as an air blowing means, whose air outlet is inserted through the wall (2) and into said plenum. In this way, a pressure rise within the plenum and an upward air flow through the grains are obtained.

By default, the fan (19) is powered by normal supply voltage, i.e. 100% power, and determines the circulating air flow rate according to the pressure drop condition imposed by the grain mass inside the silo (1), as is apparent to one skilled in the art. By using the pressure-flow curves of the fan in use, and by measuring the static pressure in the plenum, it is possible to determine the circulating air flow that can be applied to drying.

Once the circulating air flow rate is obtained, and knowing the number of tons of grains contained in the silo, it is possible to determine the quotient of dividing the flow rate by the total grain mass, expressed as ($m^3$/(min·t)), where the flow rate is preferably expressed in cubic meters per minute and the total grain mass in tons. A typical flow rate value for this type of facility is approximately 1 to 2 $m^3$/(min·t), which are relatively low flow rates compared to traditional drying facilities. Also, based on the experience gained in different climatic zones in the country, for a centrifugal type fan (19) a power of about 15 hp was enough for a typical drying facility of approximately 120 tons of corn, thereby achieving air flow rates of about 1.5 $m^3$/(min·t).

The fan being a moving mechanical device, friction in blades and other components determine an increase in the air temperature entering the plenum with regards to the ambient air, and the forced circulation of air through the grains also generates friction, resulting in an increase in static pressure which determines an additional temperature contribution due to air compression; both situations must be taken into account.

Estimated air resistance (static pressure in Pa) based on circulating air flow rate, depending on the type of grain and the total height of the grain layers can be calculated based on the ASAE D272.4 standard (American Society of Agricultural and Biological Engineers).

The temperature increase is determined by the following equation:

$$\Delta T\,(^\circ\,\text{C.}) = 0.00111 \cdot P\,(\text{Pa})$$

where ΔT is the temperature variation (increase in ° C.), P is the measurable or calculable static pressure (Pascals) and 0.00111 is a calculation constant, all this forming an equation that serves and conveniently adjusts to all purposes and all kinds of grains.

As a reference, under normal working conditions, dryer silo fan can produce an increase in air temperature of between 1.5 and 4° C.

It is then possible to calculate the reduction in relative humidity in the plenum for said temperature increase ΔT, in accordance with the ASAE D271.2 standard.

As an example, a reference Table 1 is included, relating the pressure difference to the environment pressure (Pa) taking the environment pressure as the zero reference value, and observing the corresponding relative humidity (%) and temperature (° C.) for each pressure difference regarding the plenum.

TABLE 1

| | Environment | | Plenum | | |
|---|---|---|---|---|---|
| Pressure difference to the environment (Pa) | 0 | 500 | 1000 | 1500 | 2000 |
| Relative humidity (%) | 60 | 57.9 | 56.2 | 54.2 | 52.7 |
| Temperature(° C.) | 25 | 25.6 | 26.1 | 26.7 | 27.2 |

Figure 5:
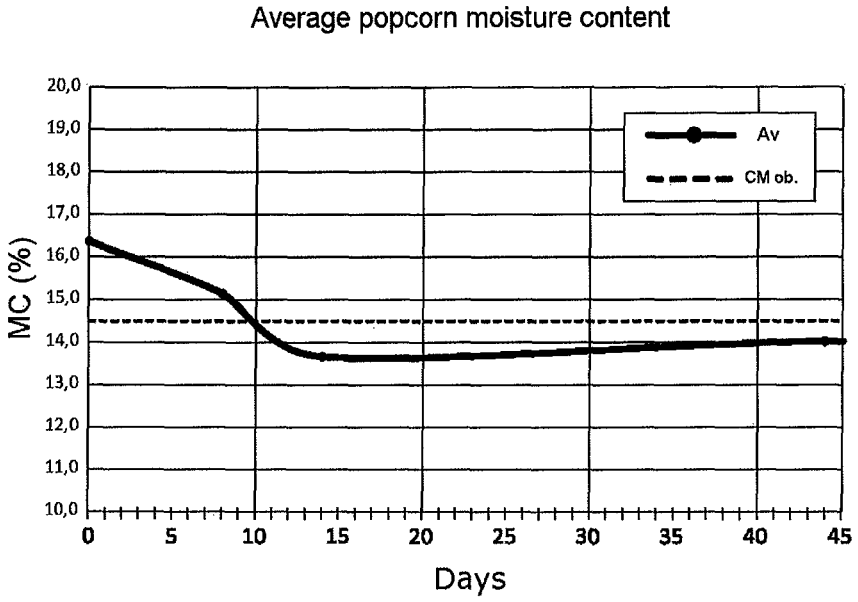
FIG. 5 is a graph illustrating the average moisture content of popcorn as a function of time.
Figure 6:
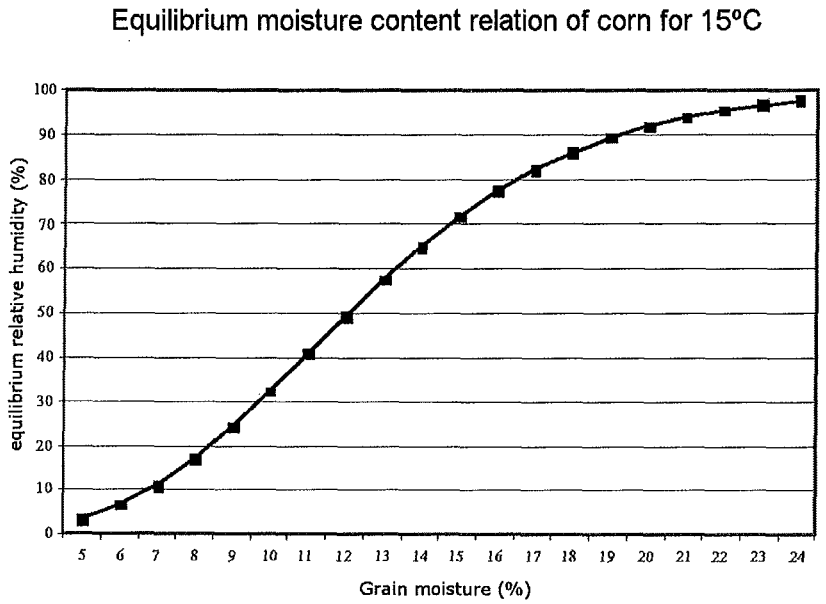
FIG. 6 is a graph illustrating the relationship between the equilibrium relative moisture content of corn at a temperature of 15° C. as a function of grain moisture.

It is also possible to calculate the grain Equilibrium Moisture Content (also referred to by its acronym "EMC"), based on ASAE Standard D245.5. Namely, the equilibrium moisture content is the moisture content "of the grain itself" that tends to stabilize or naturally maintain itself at a certain temperature and relative humidity of the environment to which it is exposed, as can be seen in FIG. 5 for popcorn. As an example, FIG. 6 illustrates a graphical relationship of the ambient relative humidity (%) at a temperature of 15° C. for corn, vs. the corresponding EMC value that can be determined in abscissas.

This means it is possible to estimate at all times the inherent moisture of the grain at which it will stabilize with time, by knowing the ambient relative humidity (%) and temperature (° C.) said grain is being exposed to. This conversion can be done in both ways based on tables or equations that relate the relative humidity (%) and the ambient temperature (° C.) to the moisture content characteristic of the grain in question, as shown in the graph in FIG. 6.

Having obtained the average initial characteristic data of the grain mass inside the silo and of the facility in the plenum due to the use of the fan (19), it is then possible to define the desired moisture range to be obtained at least for the first grain layer (G1). Said range can be expressed as having a lower grain moisture limit $H_{gi}$ from which it is undesired to trespass, and an upper grain moisture limit $H_{gs}$ which is also undesired to trespass. As a particular example some grain moisture content upper and lower limits of interest are:

| | | |
|---|---|---|
| Corn: | $H_{gi}$ = 13.5%; | $H_{gs}$ = 15% |
| Paddy rice: | $H_{gi}$ = 12.5%; | $H_{gs}$ = 14% |
| Barley: | $H_{gi}$ = 12.5%; | $H_{gs}$ = 14% |
| Sunflower: | $H_{gi}$ = 9.5%; | $H_{gs}$ = 11% |

Determination of lower and upper moisture limits in the grain can be conveniently established by determining the accepted commercial or technically required upper limit and subtracting about 1.5% to that higher value, thus obtaining a reasonable desired range in which the grain moisture content can oscillate during the adjustment of grain moisture.

Conceptually, the grain drying facility of the present invention, while carrying out the procedure described herein, will prioritarily keep the grain moisture in the first layer ($G_1$) within the preset moisture range, i.e. between the $H_{gi}$ and $H_{gs}$ limits. Accordingly, and because the process is applied in a steady and slow manner, the successive layers ($G_2$, $G_3$, etc.) will also adjust their moisture content until they reach the desired value near or equal to $H_{gs}$.

The predictive control routine applied for predicting the evolution of drying or re-humidification is carried out by an electronic control means (21) such as a computer, a programmable controller or the like. Said electronic control means may be operatively connected to a plurality of sensor means, such as the ambient temperature sensor means (23) outside the silo, the average ambient relative humidity sensor means (24) outside the silo and at least one temperature sensor means (25) within the plenum. In particular, and based on the experimental results made by the inventors of the present facility, the temperature sensing means within the air chamber (18), i.e. within the plenum, is preferably positioned at 90 degrees to the left or right with respect to the entry of air blown by the fan (19), this is better appreciated in the top view of FIG. 4.

During the moisture control process, the initial input of certain parameters necessary for the electronic control means (21) is required in order to carry out prediction of the evolution of drying or re-humidification stages as needed, these parameters are: the selection of the type of grain to be dried (e.g. popcorn, waxy corn, high oleic corn, rice, malting barley among others); the number of tons of grain loaded into the silo; the resulting specific flow rate ($m^3/(min \cdot t)$); the initial grain moisture content; and the desired final grain moisture content, as it has been discussed above for fixing the upper and lower desired grain moisture values, $H_{gs}$ and $H_{gi}$.

Additionally, said electronic control means (21), has at least one recording means for the desired bulk material moisture value (e.g. $H_{gi}$ and $H_{gs}$ values) and a means of modeling and calculating the turning on and off and regulating the operating power of said air heating means. In particular, the modeling and calculating means for predictively modeling the moisture and temperature changes of the bulk material and calculating the turning on-and-off times can be efficiently implemented by entering programming codes into a computer, or into a programmable control (PLC), so that its control logic, which for the present invention is based on a predictive duty cycle, takes the temperature and humidity values described herein in the process as inputs, and based on the time evolution and the recording of the air temperature inside the plenum, actuates on the turning on and off of the air blowing means (19) and on the turning on and off and power control of the air heating means (20).

Figure 7:
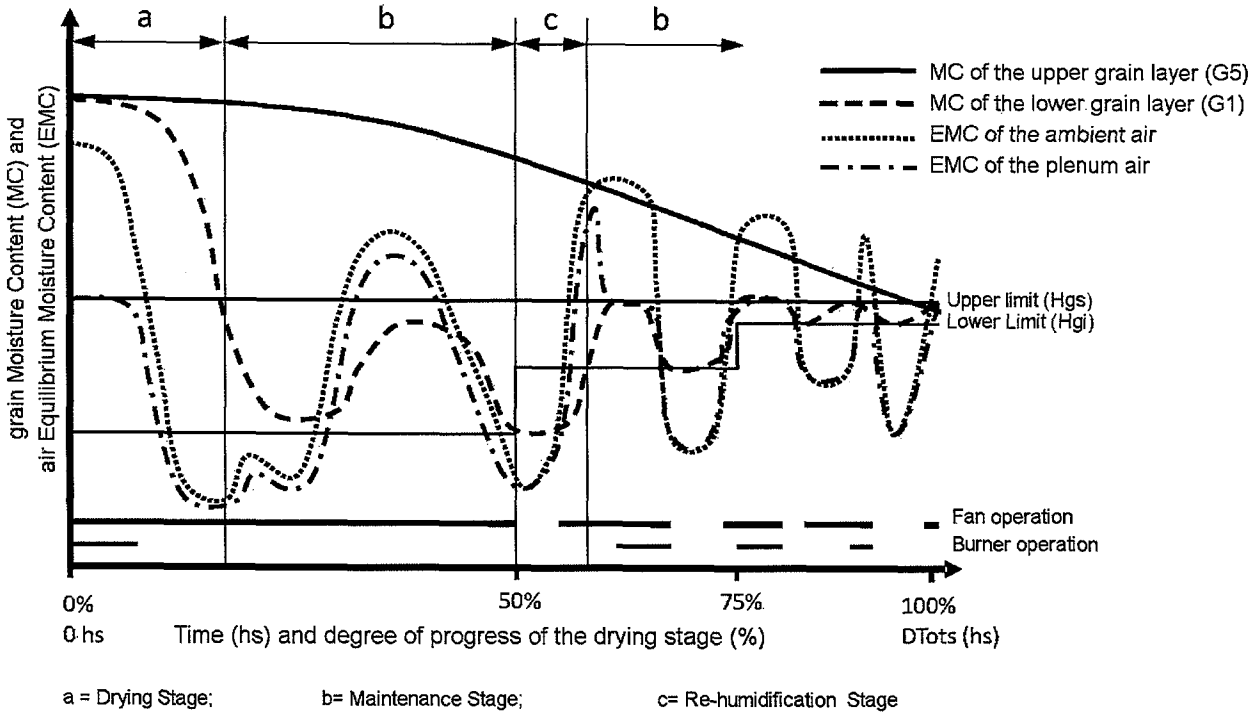
FIG. 7 is a graph showing the relationship between said variables during the grain drying and conditioning process.

Decision-making Procedure for the Modeling Means and Turning-on Time Calculation, in order to Condition Grain Moisture If the moisture of the first layer $G_1$, is greater than the preset upper limit $H_{gs}$(moist grain), a drying stage is started; on the other hand, if the moisture of the first layer G1 is smaller than the lower limit $H_{gi}$(dry grain) a re-humidification stage is started; however, if the moisture of the first layer is equal to or less than the upper limit and equal to or greater than the lower limit, this means that the grain moisture is within the desired moisture range and a maintenance stage may proceed (grain within the acceptable range). These stages are exemplified in FIG. 7 and are briefly described below:

Maintenance Stage

In said maintenance mode or stage, as the grain moisture in the $G_1$ layer is within the optimal range, only the fan is turned on, regardless of temperature and relative humidity conditions of the ambient air as it enters the plenum (fan always on), thus making ambient air circulate with constant ventilation.

Drying Stage

In said drying stage, if the equilibrium moisture content (EMC) of the ambient air upon entering the plenum of the silo is equal to or less than the upper limit $H_{gs}$, only the fan (19) is turned on, as mentioned in the maintenance stage; on the other hand if the equilibrium moisture content in the plenum of the silo is greater than the upper limit $H_{gs}$ the fan is turned on together with the heating means (20) in order to condition the air by lowering the relative humidity and consequently the grain equilibrium moisture content (EMC), calculated based on, psychrometric techniques from standard ASAE D271.2, and measuring the temperature with a temperature sensor (25) located in the plenum and the ambient relative humidity with a relative humidity sensor (24).

According to the facility of the present invention, a heating means (20) is provided which can be preferably implemented by means of a gas burner with flame control by controllable gas flow rate, said burner (20) is preferably installed to provide hot air to the fan suction inlet (19). Gas passage control may be commanded by an electronic control means (21) operatively connected to said air blowing means (19). Additionally, the air blowing means (19) implemented by means of a fan, is also commanded by said electronic control means (21) operatively connected to said fan (19) to allow commanding the turning on and off of said air blowing means and the turning on and off and adjustment of the operating power of the air heating means (20) in order to obtain a continuous adjustment of the operating power of said air heating means (20). The turning on and off of the centrifugal fan (19) is therefore understood as supplying or, respectively, interrupting the electrical power supply. It is further understood by "turning on and off the heating means (20)", the opening or closing of the gas passage, in the case of a gas burner, and control of the progressive opening or closing of the gas passage (e.g. by means of a needle valve) in order to obtain a variation in the gas flow delivered to the burner. However in case of using another heating means (20) such as heat recovery from other processes, or by electrical resistors and/or the like, the turning on and off and the adjustment will be related to the type of power supply and/or flow rate needed in order to obtain the temperature increase. Namely, usually the required temperature increase in a facility of the type described for the present invention and using a moisture control method such as the one described herein, only requires raising the inlet air temperature by about $\Delta T=5$ to 8° C. A beneficial low energy consumption is thus observed as the operating temperatures in the silo due to a relatively low air intake compared to grain dryers currently available in the market.

Re-humidification Stage

In said re-humidification stage, if the equilibrium moisture content in the plenum of the silo is greater than or equal to the lower limit $H_{gi}$ then only the fan (19) is turned on, as this will tend to increase grain moisture as mentioned in the aforementioned maintenance stage; if, on the other hand, the equilibrium moisture content of the plenum of the silo is less than the lower limit $H_{gi}$, the fan (19) is stopped in order to prevent further drying;

Whatever the mode or active stage, the change in humidity in the different layers is periodically calculated according to Thompson equilibrium model (1972), preferably at every hour. (Thompson, T L, R M Peart, and G H Foster. 1968. Mathematical simulation of corn drying—A new model. Transactions of the ASAE 24 (3):582-586).

The Thompson equilibrium model assumes that the air, after passing through a grain layer is in equilibrium with the temperature and humidity of the grain in that layer. In order to predict moisture change of the grain layer the model is based on three equilibrium equations: 1) heat balance between the air and the grain, 2) mass balance between the air and the grain and 3) equilibrium between the grain equilibrium moisture content (EMC) and the air equilibrium relative humidity (ERH).

Based on the data for temperature and relative humidity in the plenum, and applying the convenient psychrometry rules, the moisture content of the air (grams of water per kg of air) entering layer $G_1$ can be calculated. In turn, the resolution of the Thompson balance model allows predicting the temperature and relative humidity of air leaving the layer $G_1$, and thus by reapplying psychrometry, the moisture content (grams of water per kg of air) of the outgoing air can be obtained. By simple subtraction, the amount of water that each kg of air that circulated through the $G_1$ layer removed (drying) or deposited (re-humidification) in that layer, can be known. Then, multiplying the effect of each kg of air in circulation by the air flow rate in the system, the amount of water deposited or removed on said layer per unit time can be obtained. The same calculation for the second layer ($G_2$) is then performed. In this case the input air conditions in the second layer ($G_2$) are equal to the output air conditions in the preceding layer ($G_1$). Similarly, the drying or re-humidification effect that took place in the silo dryer in each of the grain layers per unit time is calculated.

The equilibrium moisture content or its inverse relation, the equilibrium relative humidity, can be calculated with Modified Chung-Pfost, Modified Halsey, Modified Oswin and Modified Henderson models, depending on which is recommended for each type of grain (ASAE D241.4).

Thus, based on the air drying conditions in the plenum of the silo and the air flow rate determined at the start of the process, the degree of overall progress of the process in the drying or re-humidification stage can be determined.

Final Adjustment of the Grain Moisture Content

As the process develops, it is important to adjust the preset value of the lower limit $H_{gi}$ of the desired humidity range, bringing it closer to the desired upper limit $H_{gs}$ as said drying or re-humidification stage proceeds.

Adjustment of the Lower limit $H_{gi}$ can be performed as follows:

As an example, the total drying time or total drying duration estimated in fan operation hours ($DTot_s$ in hours): 660/specific flow rate ($m^3$/(min*t)) as determined above.

In this instance, readings from the various sensor means (23) (24) and (25) as well as the control exerted over the burner (20) and fan (19) can be carried out by means of the aforementioned electronic control means (21) for example, a computer, an electronic processor, a programmable controller and the like located in the control cabin (22) enabling the moisture control facility to record the fan operating hours (namely the time in which it was generating a moisture change in the grain's condition) from the start. Let $D_s$ be, for example, the cumulative hours of fan operation until the time of recording and calculation. It is then possible to calculate the % of drying of the process, based on the following expression:

$$\text{Drying percentage} = \frac{D_s}{DTot_s} \times 100;$$

expressed in words;

$$\text{Current moisture adjustment percentage} = \frac{\text{current operation time}}{\text{total calculated control time}} \times 100;$$

"Drying percentage" is therefore understood as the degree of progress of the drying process of the grain in the silo (1), and thus it is possible to take the following drying percentage ranges as examples in order to increasingly adjust the lower limit to bring it closer to the upper limit:

Drying percentage within 0-50% range

Lower Limit=(upper limit−3)

Drying percentage within 50-75% range

Lower Limit=(upper limit−1.5)

Drying percentage within 75-100% range

Lower Limit=(upper limit−0.5)

From the previous calculation, if the degree of progress (drying percentage) obtained is still below 100%, then the process is returned to the decision-making stage in order to determine the implementation of a drying, re-humidification or continuous aeration (maintenance) stage. As it will be mentioned, this iteration is preferably performed at regular intervals of approximately one hour.

Obtained Final Moisture Control

Figure 8:
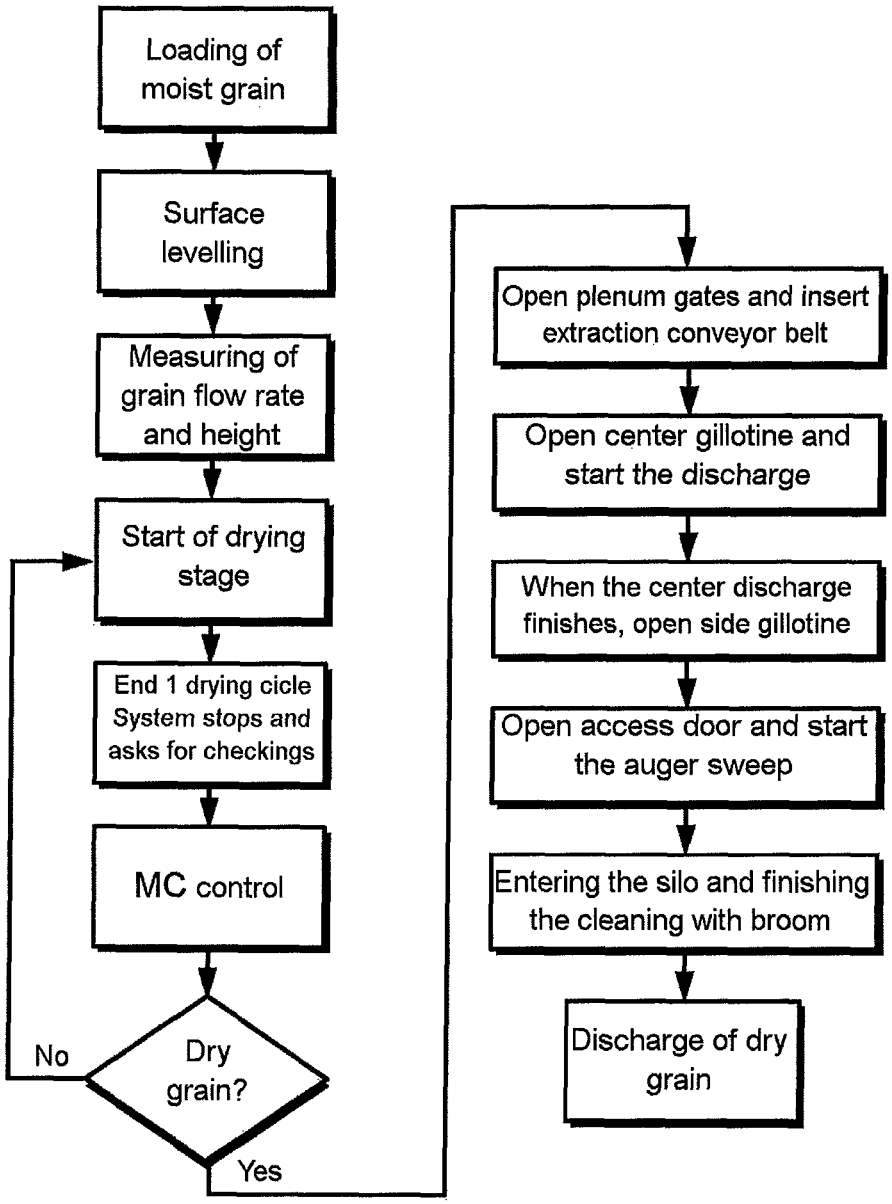
FIG. 8 shows a flowchart of the drying and conditioning process, from the loading of wet grain into the silo to the discharge of the dry grain.

When the calculated drying percentage (stage target progress) reaches 100%, the grain moisture content is verified by taking a physical grain sample of the surface of the silo content. If grain moisture determination in the sample confirms that drying was completed, then the process is ended. Otherwise, if the moisture content is not desirable, the operation of the humidity control system with the same previous parameters is extended preferably for two days, after which the grain moisture is verified again by taking a physical sample from the surface of the grain content within the silo. Thus proceeding until the desired moisture content (FIG. 8) is obtained.

As one skilled in the field of art can perceive, the grain with the desired moisture can be unloaded by gravity by use of the discharge doors (30) along with the insertion of a conveyor belt under the floor (10), which allows the final grain sweep using the sweeper auger (14) without major inconvenience.

The facility and procedure for grain moisture control as they were described, are particularly suitable for use with high commercial value grains such as popcorn, waxy corn, high oleic corn, rice, malting barley among others, giving them a gentle and gradual moisture conditioning while minimizing excessive energy consumption, all this by means of the prediction of the drying evolution based on the grain natural equilibrium to stabilize at an equilibrium moisture content, typical of the grain in accordance to the prevailing moisture and temperature conditions.

It is thus possible to obtain a suitable facility for temporarily storing the grain, and control its moisture by taking as open-cycle startup parameters the temperatures and moistures of the grain, and then predicting the evolution of drying by controlling the relative humidity of the air stream blown into the plenum that will act as an upwards circulating current to mainly evacuate the moisture of the grain contained in said silo. As a reference, it is therefore possible to obtain a gentle grain drying process of approximately 20 days obtaining a reduction of its moisture content of about 4% with respect to the initial value when it is loaded into the silo, this allowing, for example, to reduce the grain moisture in the case of popcorn in 20 days from 18% to 14%, making it suitable for commercialization and conservation.

It should be noted that unlike known electronic control cycles which feed back evident information such as grain temperature and humidity readings throughout the entire process, the facility and procedure of the present invention are based on a predictive modeling which starts in an open cycle mode with initial reading parameters and subsequently progresses by stages that prioritize a gentle, natural drying or conditioning of the grain moisture.

The invention claimed is:

1. A procedure for controlling moisture in bulk material selected from grains or seeds to be applied to a moisture control facility, said facility comprising: at least one silo container of bulk material, said silo comprising a flat base floor made of a rigid material on which the perimeter wall of said silo is positioned and held, an elevated floor with respect to said base floor, contained within the perimeter wall of the silo, wherein said elevated floor comprises a plurality of holes defining air passages having surface of 15% to 30% of the total area of the elevated floor, an air chamber being defined between said base floor and said elevated floor, an air blower for blowing an air stream towards said air chamber connected through said perimeter wall, an air heater connected prior to the entry of the air stream into said air chamber, at least one air temperature sensor in at least one temperature reading point located inside the air chamber, and at least one air temperature sensor located externally of said silo, and at least one ambient air relative humidity sensor located externally of said silo, an electronic controller operatively connected to said air blower, to said air heater, to said air temperature sensor located inside the air chamber, to said air temperature sensor located externally of said silo, and to said ambient air relative humidity sensor located externally of said silo;

said electronic controller including a data recorder of said sensor, a humidity recorder for recording a desired moisture value of the bulk material and a modeling and calculating means for predictively modeling the moisture and temperature changes of the bulk material and calculating the turning on-and-off times, and operating the power control of said air blower and air heater, the procedure comprising establishing a layer division of the bulk material contained in said silo, thereby determining a plurality of layers of bulk material;

measuring initial moisture and temperature values of at least the bottom layer of said plurality of layers;

recording said initial moisture and temperature values of at least said bottom layer in said data recorder of said electronic controller;

recording a desired moisture value of the bulk material selected from an accepted commercial or technically required moisture limit for the bulk material in said data recorder of said electronic controller;

establishing a circulating flow rate of air from said air blower;

recording said circulating flow rate of air in said data recorder of said electronic controller;

determining by said predictive modeling and calculating means a moisture range comprising an upper moisture limit equal to the desired moisture value of the bulk material and a lower moisture limit 3.0% under the upper moisture limit; and said upper and lower limits establish an initial preset tolerance range in respect of said recorded desired moisture value of the bulk material;

determining by said predictive modeling and calculating means the activation of a stage selected from the group comprising a drying stage, a maintenance stage and a re-humidification stage;

wherein said stage is selected according to the moisture value of said bottom layer from the grains contained in the silo, based on the comparison of said lower moisture limit and said upper moisture limit in relation to said moisture value of said bottom layer;

wherein said drying stage, maintenance stage and re-humidification stage comprise the periodic calculation of the temperature and humidity variation of each layer of said plurality of layers, based on the temperature value of said temperature sensor in said air chamber, and on the ambient air relative humidity and temperature value of said sensors located externally to said silo, determining by use of said modeling and calculation means using equilibrium equations comprising at least one heat balance equation between the air and the bulk material, at least one mass balance equation between the air and the bulk material, and at least one equilibrium equation between the equilibrium moisture content (EMC) of the bulk material and the air equilibrium relative humidity (ERH), the degree of progress in the active stage, until said stage reaches one hundred percent progress, and additionally, and wherein as said drying or re-humidification stage progresses, in predetermined time periods, the lower moisture limit preset value is adjusted, bringing it closer to the upper moisture limit; wherein the setting of the lower moisture limit is carried out as follows:

taking the reading from said sensor means and obtaining the record for the current operating time of said air blower since the beginning of this procedure, calculating the current drying % the process has achieved, based on the following equation:

$$\text{Current Drying \%} = \frac{\text{Current operation time}}{\text{Total Calculated Control Time}} \cdot 100$$

wherein said Total Calculated Control Time is obtained from the following equation $$\text{Total calculated control time} = \frac{660}{\text{Specific flow rate}}$$

wherein said current moisture adjustment percentage allows said electronic controller to determine the current drying % of the moisture adjustment process of said bulk material, wherein a new lower moisture limit is selected from the group comprising:

a new lower moisture limit=(Upper limit−3) if the current drying % is within the range of 0 to 50%;

a new lower moisture limit=(Upper limit−1.5) if the current drying % is within the range of 50 to 75%; and a new lower moisture limit=(Upper limit−0.5) if the current drying % is within the range of 75 to 100%;

wherein if the current drying % is less than 100%, the procedure proceeds again starting the modeling and calculation, wherein a stage is selected according to the calculated moisture value based on the prediction of the electronic controller, according to said modeling and calculating means in said first lower layer selected from said bulk material contained in said silo, based on the comparison of at least said new lower moisture limit and said upper moisture limit with respect to said moisture value calculated based on said prediction of said electronic controller according to said modeling and calculation means;

recording the relative ambient humidity by means of said relative ambient humidity (%) sensor and the ambient temperature (° C.) obtained by said ambient temperature sensor to which said bulk material is being exposed to;

calculating by said electronic controller the Equilibrium Moisture Content (EMC) of said bulk material type, as an indicator of the moisture content at which said bulk material will stabilize over time; and establishing the activation of said air blower and said air heater based on the air temperature in said air chamber, the desired moisture value stored in said recorder, the EMC, the relative ambient humidity and the ambient temperature.

2. The procedure according to claim 1, wherein said air blower comprises a centrifugal fan, with an air flow rate depending on the bulk material weight in the range of 1 to 2 $m^3$/(min·t), and said air heater comprises a gas burner.

3. The procedure according to claim 1, wherein said base floor is made of concrete and said plurality of holes comprises circular holes of approximately 4 mm in diameter.

4. The procedure according to claim 1, wherein said air temperature sensor in at least one temperature reading point located inside the air chamber is positioned approximately 90 degrees to the left or to the right with respect to the entrance of the air blown by the air blower.

5. The procedure according to claim 1, wherein said drying stage comprises the activation of said air blower and when the calculated temperature and EMC in said air chamber (19) does not allow drying, said air heater and in which this drying stage is activated if the moisture value of said first bottom layer of bulk material is greater than said upper moisture limit.

6. The procedure according to claim 1, wherein said maintenance stage comprises the activation of said air blower and wherein said maintenance stage is activated when said moisture value of said first bottom layer of bulk material is within the range determined by said upper and lower moisture limits.

7. The procedure according to claim 1, wherein said re-humidification stage comprises the activation of said air blower, when the calculated temperature and EMC in said air chamber (19) allow the re-humidification and wherein this re-humidification stage is activated if said moisture value of the first bottom layer of material bulk is below said lower moisture limit.

8. The procedure according to claim 1, wherein said means for modeling and calculating the on-and-off times of said blower as well as for operating the power control of said air heater, carries out the following stages of:

a) calculating the temperature rise and relative humidity drop in the silo air chamber caused by the friction of the fan when forcing the circulation of air through the grain;

b) calculating the estimated air resistance (Static Pressure) based on the air flow rate, bulk material type and height of the bulk material mass, according to ASAE D272.3 standard, performed and published by the American Society of Agricultural Engineers, 1996 (revised 2011);

c) calculating the increase in temperature according to the following equation:

$$\text{Temp. Increase (° C.)} = 0.00111 \cdot \text{Static Pressure (Pa)}$$

d) calculating the reduction of the relative humidity in the air chamber for said temperature increase, according to ASAE D271.2 standard, performed and published by the American Society of Agricultural Engineers, 1979 (revised 2014) and e) calculating the equilibrium moisture content of drying air based on ASAE D245.6 standard, performed and published by the American Society of Agricultural Engineers, 2007 (revised 2012).

* * * * *